US008853578B2

(12) United States Patent
Alberti et al.

(10) Patent No.: US 8,853,578 B2
(45) Date of Patent: Oct. 7, 2014

(54) MULTI MOTION SWITCH WITH MULTIPLIER ARM

(75) Inventors: Daniel J. Alberti, Brookfield, WI (US); Roger D. Neitzell, Palmyra, WI (US); Andrew J. Weber, Cudahy, WI (US); Troy C. Thorson, Waukesha, WI (US); Jeffrey M. Wackwitz, Pewaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 131 days.

(21) Appl. No.: 13/515,892

(22) PCT Filed: Dec. 17, 2010

(86) PCT No.: PCT/US2010/061100

§ 371 (c)(1),
(2), (4) Date: Jun. 14, 2012

(87) PCT Pub. No.: WO2011/075675

PCT Pub. Date: Jun. 23, 2011

(65) Prior Publication Data

US 2013/0032455 A1 Feb. 7, 2013

Related U.S. Application Data

(60) Provisional application No. 61/288,002, filed on Dec. 18, 2009.

(51) Int. Cl.

| | |
|---|---|
| ***H01H 3/20*** | (2006.01) |
| ***H01H 21/36*** | (2006.01) |
| ***H01H 9/06*** | (2006.01) |
| ***H01H 21/24*** | (2006.01) |
| *H01H 3/46* | (2006.01) |

(52) U.S. Cl.

CPC ..... *H01H 9/06* (2013.01); *H01H 21/36* (2013.01); *H01H 21/24* (2013.01); *H01H 3/46* (2013.01); *H01H 2217/01* (2013.01)

USPC ..... 200/332

(58) Field of Classification Search

USPC ..... 200/332, 5 B, 50.3, 50.32
IPC ..... H01H 13/186,9/26, 71/1009; H01R 13/707
See application file for complete search history.

(56) References Cited

U.S. PATENT DOCUMENTS 3,881,081 A 4/1975 Schilling et al.
4,122,320 A * 10/1978 Edgell et al. ..... 200/43.17

(Continued)

FOREIGN PATENT DOCUMENTS

DE 3638952 A1 5/1988
DE 3701994 A1 8/1988

(Continued)

OTHER PUBLICATIONS

International Search Report and Written Opinion for Application No. PCT/US20101061100 dated Aug. 2, 2011 (7 pages).

*Primary Examiner* — Vanessa Girardi
(74) *Attorney, Agent, or Firm* — Michael Best & Friedrich LLP

(57) ABSTRACT

A power tool having a paddle switch is configured to allow easier actuation of a switch mechanism. The power tool comprises a housing, a support surface disposed within the housing, a switch mechanism having a first position and a second position, a paddle member including an input surface and a hinge pin positioned a distance from the support surface, and a multiplier member pivotally connected to the hinge pin and having a first arm and a second arm. The first arm of the multiplier member extends from the hinge pin along a first longitudinal axis, and the second arm of the multiplier member extends from the hinge pin along a second longitudinal axis that is not parallel to the first longitudinal axis. The second arm is disposed to contact the support surface when force is applied to the input surface, causing rotation of the multiplier member about the hinge pin. The rotation of the hinge pin causes the first arm to contact the switch mechanism and move it from the first position to the second position.

22 Claims, 4 Drawing Sheets

(56) References Cited

U.S. PATENT DOCUMENTS

| | | | |
|---|---|---|---|
| 4,276,459 | A | 6/1981 | Willett et al. |
| 4,830,526 | A | 5/1989 | Hosono |
| 4,879,438 | A | 11/1989 | Winchester |
| 5,072,086 | A | 12/1991 | Fujiyoshi |
| 5,117,075 | A | 5/1992 | Guilleminot |
| 5,165,531 | A | 11/1992 | Kawakami et al. |
| 5,329,080 | A | 7/1994 | Pierce et al. |
| 5,428,197 | A | 6/1995 | McCurry et al. |
| 5,681,214 | A | 10/1997 | Kleider et al. |
| 5,819,914 | A | 10/1998 | Yoneyama |
| 5,823,325 | A | 10/1998 | Lin |
| 6,812,419 | B2 | 11/2004 | Fukui et al. |
| 7,009,145 | B2 | 3/2006 | Bauer |
| 7,138,593 | B2 | 11/2006 | Toyoda |
| 7,250,579 | B2 | 7/2007 | Ahlers et al. |
| 7,281,591 | B2 | 10/2007 | Bone |
| 7,291,796 | B2 | 11/2007 | Liu et al. |
| 7,525,054 | B2 * | 4/2009 | Ng et al. ..... 200/10 |

FOREIGN PATENT DOCUMENTS

| | | | |
|---|---|---|---|
| DE | 4208372 | A1 | 9/1993 |
| EP | 0199983 | A1 | 11/1986 |
| EP | 0199983 | B1 | 3/1989 |
| EP | 0604837 | A1 | 7/1994 |
| EP | 1313116 | A2 | 5/2003 |
| JP | 8055541 | A | 2/1996 |
| WO | 2005/013301 | A2 | 2/2005 |
| WO | 2005/013651 | A2 | 2/2005 |
| WO | 2007/053966 | A2 | 5/2007 |

* cited by examiner

MULTI MOTION SWITCH WITH MULTIPLIER ARM

This application claims the benefit of U.S. provisional application no. 61/288,002, filed Dec. 18, 2009, the entire contents of which are incorporated herein by reference.

TECHNICAL FIELD

The invention relates to activation switches, and more particularly to paddle switches for power tools.

BACKGROUND ART

Paddle switches on power tools have the advantage of providing the user with the ability to activate the power tool from various hand positions on the tool. Current power tools commonly use paddle switches that pivot on one end. This has the disadvantage of requiring more force to actuate the switch at the pivot end of the switch than at the non-pivot end. In some cases, the switch cannot be actuated on the pivot side of the switch. Another disadvantage of paddle switches that pivot on one end is that they require more displacement to actuate the switch on the non-pivot side of the switch.

SUMMARY OF THE INVENTION

In one embodiment, the invention provides a power tool comprising a housing, a support surface, a switch mechanism, a paddle member, and a multiplier member. The support surface is disposed within the housing. The switch mechanism has a first position and a second position. The paddle member has an input surface upon which an input force is applied. The paddle member also has a hinge pin positioned a distance from the support surface such that application of force on the input surface alters the distance between the hinge pin and the support surface. The multiplier member is pivotally connected to the hinge pin. The multiplier member has a first arm extending from the hinge pin along a first longitudinal axis and a second arm extending from the hinge pin along a second longitudinal axis that is not parallel to the first longitudinal axis. When a force is applied at the input surface, the second arm contacts the support surface, causing the multiplier member to rotate about the hinge pin. This rotation causes the first arm to contact a switch mechanism and move it from the first position to the second position.

In another embodiment, the invention provides a power tool comprising a housing, a paddle member, a support surface, a pivot member, a switch mechanism, and a multiplier member. The paddle member includes an input surface upon which an input force is applied. The support surface is disposed within one of the housing and the paddle member. The pivot member is connected to the other of the housing and the paddle member and positioned a distance from the support surface such that application of force on the input surface alters the distance between the pivot member and the support surface. The switch mechanism has a first position and a second position. The multiplier member is connected to the pivot member. The multiplier member has a first arm extending from the pivot member parallel to a first longitudinal axis and a second arm extending from the pivot member parallel to a second longitudinal axis that is not parallel to the first longitudinal axis. When force is applied at the input surface, the second arm is disposed to contact the support surface and cause an angular displacement of the first arm and the second arm with respect to the pivot member. The angular displacement causes the first arm to move the switch mechanism from a first position to a second position.

In another embodiment, the invention provides a paddle switch for a power tool where the paddle does not have a fixed pivot. A multiplier arm mounted to the paddle gives a user the ability to actuate the paddle at a first end, a second end, or the center of the paddle. The multiplier arm can also provide multiplication of displacement of the paddle, allowing a lower profile paddle that requires shorter displacement to activate the power tool.

Other aspects of the invention will become apparent by consideration of the description and accompanying drawings.

MODES FOR CARRYING OUT THE INVENTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Embodiments of the invention allow a user to actuate a switch more easily, regardless of the location at which the user applies an input force. Various embodiments utilize a lever arm to transmit a force applied at the paddle surface to a switch mechanism. As such, a user need not apply more force to actuate the switch at the pivot end than at the non-pivot end.

Figure 1:
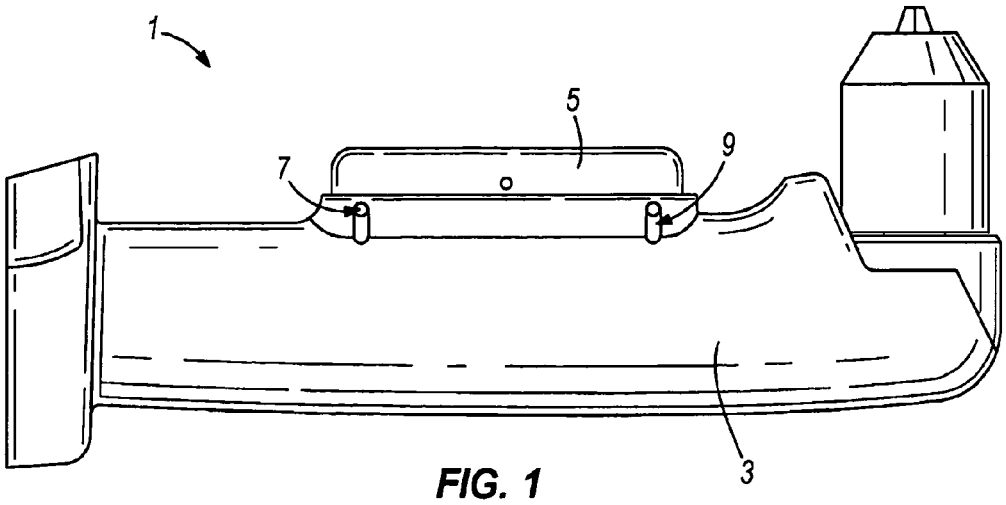
FIG. 1 is a side view of a power tool handle having a paddle switch, where the paddle is shown in the unactuated position.

FIG. 1 illustrates a handle of a power tool 1 comprising a housing 3 and a paddle 5. The paddle 5 includes guide pins 7 that slide within slots 9 in the housing 3 when the paddle 5 is actuated toward the housing 3. The paddle 5 also includes a biasing means, such as a spring (not shown). The biasing means applies a force that biases the paddle 5 and a switch 27 towards an open position.

Figure 2:
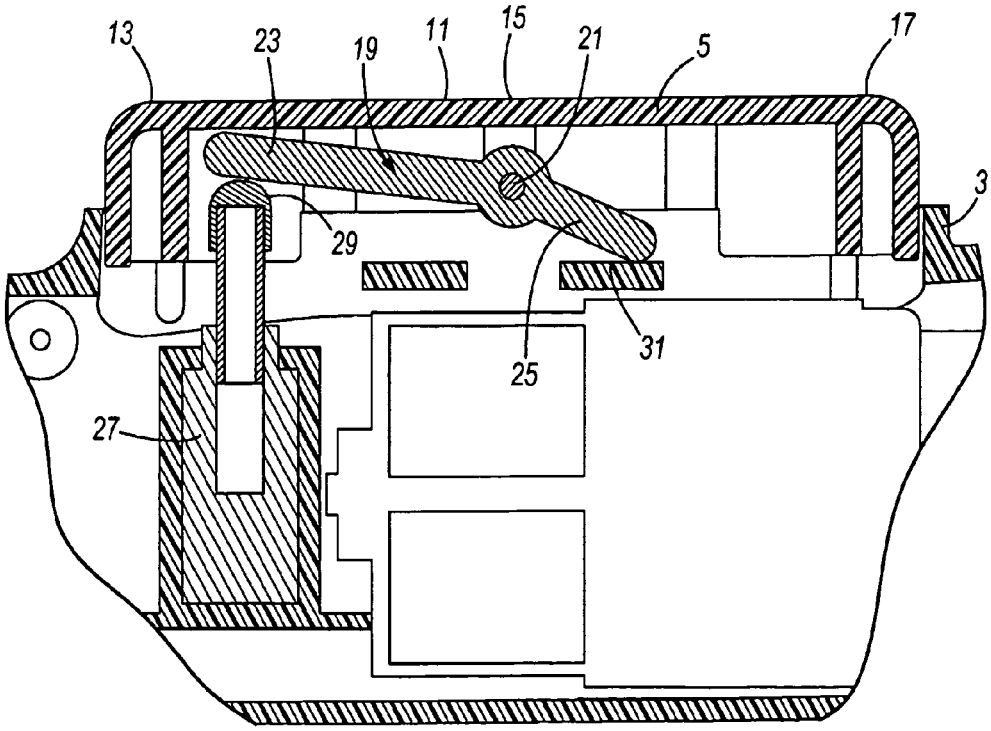
FIG. 2 is a magnified sectional side view of the power tool handle and paddle switch shown in FIG. 1, where the paddle is shown in the unactuated position.

FIG. 2 illustrates a top surface 11 of the paddle 5 having a first end 13, a center 15, and a second end 17. A multiplier arm 19 having a multiplier hinge 21 is rotatably mounted to the paddle 5. The multiplier arm 19 includes a long arm 23 on one end of the multiplier hinge 21 and a short arm 25 on the opposite end of the multiplier hinge 21. The short arm 25 is disposed at an angle relative to the long arm 23. A switch 27 having a switch cap 29 is mounted within the housing 3. A portion of the housing 3 forms a multiplier support ledge 31 that contacts the short arm 25 of the multiplier arm 19. The multiplier arm 19 is free to rotate in response to a change in the position of the multiplier hinge 21 relative to the multiplier support ledge 31.

It will be appreciated by one skilled in the art that the multiplier arm 19 can take other forms including various arm lengths, various arm shapes, and various angles, and that the multiplier arm 19 can be used to actuate multiple switches or can be slidably and rotatably mounted. In addition, the multiplier arm 19 can be mounted in a different position or have multiple axes of rotation. For instance, the multiplier hinge 21 can be a ball-and-socket connection. In other embodiments, the multiplier support ledge 19 can be formed on a component within the housing 3 instead of on the housing 3 itself. In still other embodiments, multiple multiplier arms can be used.

Figure 3:
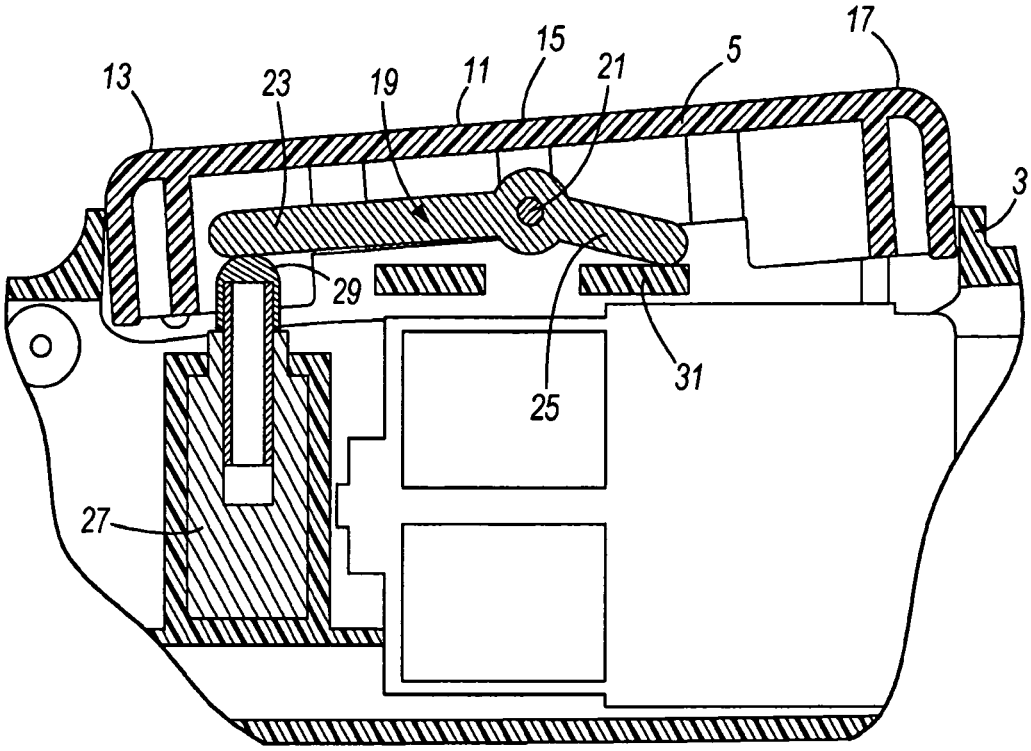
FIG. 3 is a magnified sectional side view of the power tool handle and paddle switch shown in FIG. 1, showing the input force being applied to the paddle surface at one end of the paddle.

As shown in FIG. 3, when the user applies actuating force to the first end 13 of the top surface 11 of the paddle 5, the paddle 5 pivots and the center 15 and first end 13 of the paddle 5 are displaced toward the housing 3. As the multiplier hinge 21 is displaced with the paddle 5, the short arm 25 contacts and slides along the multiplier support ledge 31, causing the multiplier arm 19 to rotate around the multiplier hinge 21. The rotation displaces the long arm 23 of the multiplier arm 19 toward the housing 3 so that the long arm 23 contacts the switch cap 29 and actuates the switch 27. When the user releases the actuating force, the paddle 5 and switch 27 return to their biased open positions.

Figure 4:
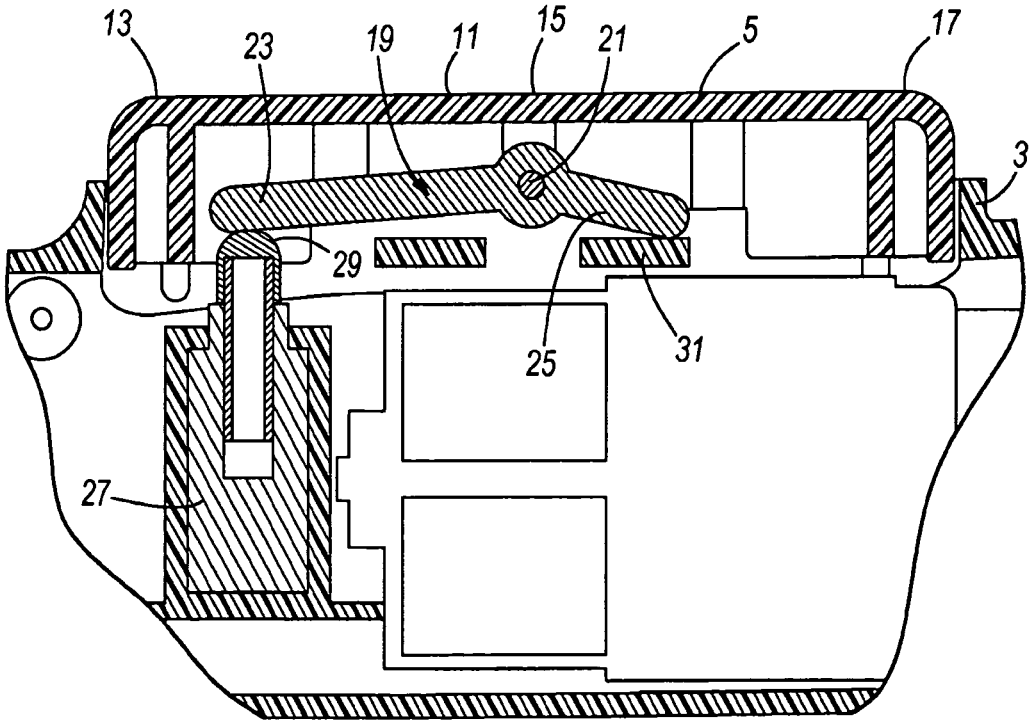
FIG. 4 is a magnified sectional side view of the power tool handle and paddle switch shown in FIG. 1, showing the input force being applied to the paddle surface at the center of the paddle.

As shown in FIG. 4, when the user applies actuating force to the center 15 of the top surface 11 of the paddle 5, the entire paddle 5 is displaced toward the housing 3. Actuation of the center 15 of the paddle 5 actuates the switch 27 in a similar fashion to actuation of the first end 13 of the paddle 5 described above. As the multiplier hinge 21 is displaced with the paddle 5, the short arm 25 contacts and slides along the multiplier support ledge 31, causing the multiplier arm 19 to rotate around the multiplier hinge 21. The rotation displaces the long arm 23 of the multiplier arm 19 toward the housing 3 so that the long arm 23 contacts the switch cap 29 and actuates the switch 27. When the user releases the actuating force, the paddle 5 and switch 27 return to their biased open positions.

Figure 5:
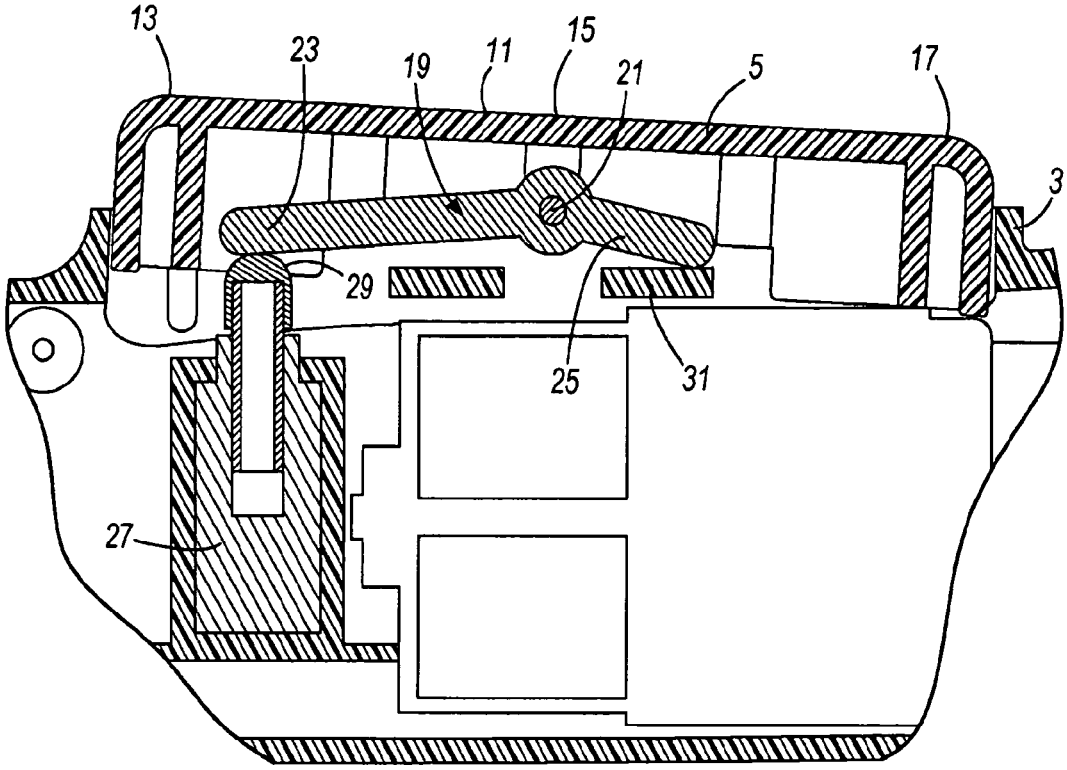
FIG. 5 is a magnified sectional side view of the power tool handle and paddle switch shown in FIG. 1, showing the input force being applied to the paddle surface at the end of the paddle opposite the end actuated in FIG. 3.

As shown in FIG. 5, when the user applies actuating force to the second end 17 of the top surface 11 of the paddle 5, the paddle 5 pivots and the center 15 and second end 17 of the paddle 5 are displaced. Actuation of the second end 17 of the paddle 5 actuates the switch 27 in a similar fashion to actuation of the center 15 or the first end 13 of the paddle 5 described above. As the multiplier hinge 21 is displaced with the paddle 5, the short arm 25 contacts and slides along the multiplier support ledge 31, causing the multiplier arm 19 to rotate around the multiplier hinge 21. The rotation displaces the long arm 23 of the multiplier arm 19 so that the long arm 23 contacts the switch cap 29 and actuates the switch 27. When the user releases the actuating force, the paddle 5 and switch 27 return to their biased open positions.

Figure 6:
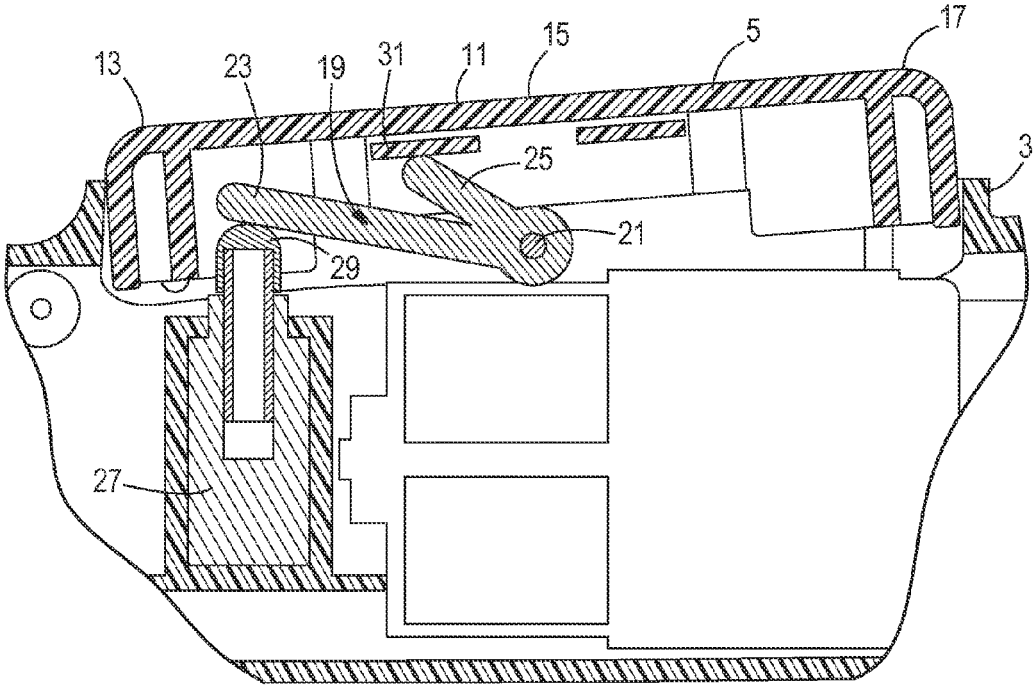
FIG. 6 is a section view of a power tool handle and paddle switch according to another embodiment, showing an input force applied to the paddle surface at one end of the paddle.
Figure 7:
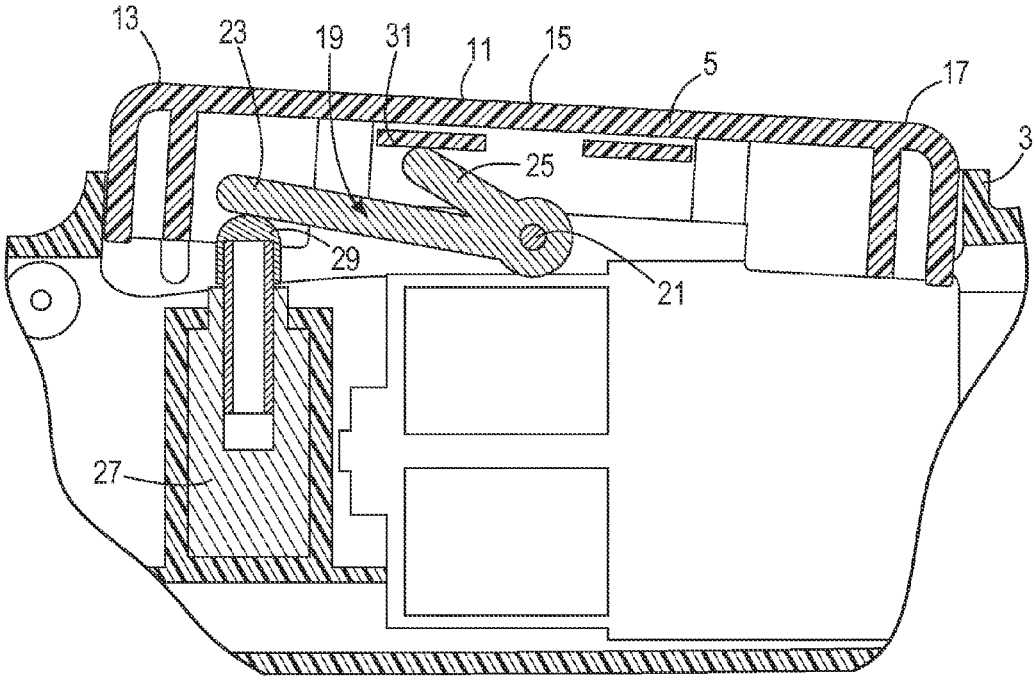
FIG. 7 is a section view of the power tool and paddle switch shown in FIG. 6, with the input force applied to the paddle surface at the end of the paddle opposite the end actuated in FIG. 6.

Alternatively, as shown in FIGS. 6 and 7, the multiplier hinge 21 can be mounted to the housing 3 or a component within the housing 3. The multiplier support ledge 31 is then attached to or formed as part of the paddle 5. The force applied on the paddle 5 changes the relative position between the multiplier support ledge 31 and multiplier hinge 21, causing rotation of the multiplier arm 19.

Alternatively, the long arm 23 may be moved into contact with the switch cap 29 by elastic deformation of the multiplier arm 19. In this arrangement, the application of the input force on the top surface 11 of the paddle 5 causes the multiplier arm 19 to experience elastic deformation such that the relative angular positions of the long arm 23 and the short arm 25 about the multiplier hinge 21 are changed. The applied force is therefore transmitted to the switch cap 29 by the long arm 23. The applied force changes the relative position between the multiplier support ledge 31 and the multiplier hinge 21.

The paddle 5 can be actuated at any point along a longitudinal axis defined by the length of the paddle top surface 11 in addition to, or instead of, the first end 13, the center 15, and the second end 17. The above-described principle of operation applies, though the amount of displacement and/or rotation of the paddle 5, multiplier arm 19, and/or related members may vary. Furthermore, the multiplier hinge 21 may be configured to allow rotation in two directions. For instance, the multiplier hinge 21 can be a ball-and-socket joint. In this embodiment, the paddle 5 can be actuated regardless of the position of the force along the longitudinal axis and regardless of the position of the force along a transverse axis that is perpendicular to the longitudinal axis.

Embodiments herein can be used, for example, to activate power tools, test and measurement equipment, vacuum cleaners, outdoor power equipment, and vehicles. Power tools include, for example, drills, circular saws, jig saws, band saws, reciprocating saws, screw drivers, angle grinders, straight grinders, hammers, impact wrenches, angle drills, inspection cameras, and the like. Test and measurement equipment includes digital multimeters, clamp meters, fork meters, wall scanners, IR temperature guns, and the like. Vacuum cleaners include stick vacuums, hand vacuums, upright vacuums, carpet cleaners, hard-surface cleaners, canister vacuums, broom vacuums, and the like. Outdoor power equipment includes blowers, chain saws, edgers, hedge trimmers, lawn mowers, trimmers, and the like.

Various features and advantages of the invention are set forth in the claims.

The invention claimed is:

1. A power tool, comprising:

a housing;

a support surface disposed within the housing;

a switch mechanism having a first position and a second position;

a paddle member including an input surface and a hinge pin, the hinge pin positioned a distance from the support surface such that application of force on the input surface alters the distance between the hinge pin and the support surface; and a multiplier member pivotally connected to the hinge pin, the multiplier member comprising a first arm and a second arm, the first arm extending from the hinge pin along a first longitudinal axis, the second arm extending from the hinge pin along a second longitudinal axis that is not parallel to the first longitudinal axis, the second arm being disposed to contact the support surface when force is applied to the input surface, causing rotation of the multiplier member about the hinge pin, wherein the rotation of the multiplier member about the hinge pin causes the first arm to contact the switch mechanism and move it from the first position to the second position.

2. The power tool of claim 1, wherein the support surface comprises a ledge rigidly connected to the housing.

3. The power tool of claim 1, wherein the paddle member further includes a biasing means that applies a biasing force for biasing the paddle member away from the housing.

4. The power tool of claim 3, wherein the paddle member further includes a retaining means for retaining the paddle member in the housing against the biasing force.

5. The power tool of claim 4, wherein the retaining means comprise a plurality of guide pins that slide within guide slots disposed on the housing.

6. A power tool, comprising:

a housing;

a paddle member including an input surface;

a support surface disposed within one of the housing and the paddle member, wherein the support surface comprises a ledge rigidly connected to one of the housing and the paddle member;

a pivot member connected to the other of the housing and the paddle member, and positioned a distance from the support surface such that application of force on the input surface alters the distance between the pivot member and the support surface;

a switch mechanism having a first position and a second position; and a multiplier member connected to the pivot member, the multiplier member comprising a first arm and a second arm, the first arm extending from the pivot member parallel to a first longitudinal axis, the second arm extending from the pivot member parallel to a second longitudinal axis that is not parallel to the first longitudinal axis, the second arm being disposed to contact the support surface when force is applied to the input surface, causing angular displacement of the first arm and the second arm about the pivot member, and wherein the angular displacement of the multiplier arm causes the first arm to move the switch mechanism from a first position to a second position.

7. The power tool of claim 6, wherein the paddle member is movable in a first direction toward the housing, and wherein the pivot member is offset from the support surface in a direction that is generally transverse with respect to the first direction.

8. The power tool of claim 6, wherein the angular displacement of the first arm and the second arm is accomplished through rotation of the multiplier member about the pivot member.

9. The power tool of claim 6, wherein the paddle member is biased away from the housing.

10. The power tool of claim 9, wherein the paddle member is retained with respect to the housing by at least one guide pin that is slidable within a guide slot.

11. The power tool of claim 6, wherein the paddle member further includes a biasing means that applies a biasing force for biasing the paddle member away from the housing.

12. The power tool of claim 11, wherein the paddle member further includes a retaining means for retaining the paddle member in the housing against the biasing force.

13. The power tool of claim 12, wherein the retaining means comprise a plurality of guide pins that slide within guide slots disposed on the housing.

14. A power tool, comprising:

a housing;

a paddle member including an input surface;

a support surface disposed within one of the housing and the paddle member;

a pivot member connected to the other of the housing and the paddle member, and positioned a distance from the support surface such that application of force on the input surface alters the distance between the pivot member and the support surface;

a switch mechanism having a first position and a second position;

a multiplier member connected to the pivot member, the multiplier member comprising a first arm and a second arm, the first arm extending from the pivot member parallel to a first longitudinal axis, the second arm extending from the pivot member parallel to a second longitudinal axis that is not parallel to the first longitudinal axis, the second arm being disposed to contact the support surface when force is applied to the input surface, causing angular displacement of the first arm and the second arm about the pivot member, and wherein the angular displacement of the multiplier arm causes the first arm to move the switch mechanism from a first position to a second position;

wherein the paddle member further includes:

a biasing means that applies a biasing force for biasing the paddle member away from the housing; and a retaining means for retaining the paddle member in the housing against the biasing force, wherein the retaining means comprise a plurality of guide pins that slide within guide slots disposed on the housing.

15. The power tool of claim 14, wherein the support surface comprises a ledge rigidly connected to one of the housing and the paddle member.

16. The power tool of claim 14, wherein the angular displacement of the first arm and the second arm is accomplished through rotation of the multiplier member about the pivot member.

17. The power tool of claim 14, wherein the paddle member is movable in a first direction toward the housing, and wherein the pivot member is offset from the support surface in a direction that is generally transverse with respect to the first direction.

18. A power tool, comprising:

a housing;

an elongated paddle member having a first end and a second end and including an input surface, the first end being movable toward and away from the housing, the second end being movable toward and away from the housing;

a support surface positioned on the paddle member;

a switch mechanism having a first position and a second position;

a pivot member coupled to the housing and positioned a distance from the paddle member such that application of force on the input surface alters the distance between the pivot member and the paddle member;

a multiplier member connected to the pivot member and including a first arm, the multiplier member configured to contact the support surface such that application of force on the input surface causes angular displacement of the multiplier member about the pivot member, wherein, when force is applied proximate the first end of the paddle member, the angular displacement of the multiplier arm causes the first arm to move the switch mechanism from the first position to the second position, and when force is applied proximate the second end of the paddle member, the angular displacement of the multiplier arm also causes the first arm to move the switch mechanism from the first position to the second position.

19. The power tool of claim 18, wherein the multiplier member includes a second arm extending at an angle relative to the first arm, wherein the second arm is configured to contact the support surface.

20. The power tool of claim 18, wherein the paddle member is movable in a first direction toward the housing, and wherein the pivot member is offset from the support surface in a direction that is generally transverse with respect to the first direction.

21. The power tool of claim 18, wherein the paddle member is biased away from the housing.

22. The power tool of claim 21, wherein the paddle member is retained with respect to the housing by at least one guide pin that is slidable within a guide slot.

* * * * *